US007121425B2

(12) United States Patent
Shanabrook

(10) Patent No.: US 7,121,425 B2
(45) Date of Patent: Oct. 17, 2006

(54) PAINT CAN WITH DRAIN HOLES AND TOOL FOR FORMING THE HOLES

(76) Inventor: Shawn L. Shanabrook, P.O. Box 198, Camino, CA (US) 95709

( * ) Notice: Subject to any disclaimer, the term of this patent is extended or adjusted under 35 U.S.C. 154(b) by 72 days.

(21) Appl. No.: 10/849,597

(22) Filed: May 20, 2004

(65) Prior Publication Data

US 2005/0258176 A1 Nov. 24, 2005

(51) Int. Cl.
*B65D 43/02* (2006.01)

(52) U.S. Cl. ..... 220/797; 30/363

(58) Field of Classification Search ..... 30/363, 30/364, 366; 220/302, 303, 304, 305, 797; 215/302, 303, 304, 305

See application file for complete search history.

(56) References Cited

U.S. PATENT DOCUMENTS

| | | | | | |
|---|---|---|---|---|---|
| 1,890,955 | A * | 12/1932 | Spengler | 30/363 |
| 3,835,860 | A * | 9/1974 | Garretson | 606/79 |
| 4,416,039 | A * | 11/1983 | Miller | 27/21.1 |
| 4,707,924 | A * | 11/1987 | Burney | 30/363 |
| 5,022,253 | A * | 6/1991 | Parlatore | 72/325 |
| 5,722,142 | A * | 3/1998 | Myers | 29/268 |
| 6,751,874 | B1 * | 6/2004 | Eldar | 30/363 |

* cited by examiner

*Primary Examiner*—Lien M. Ngo
(74) *Attorney, Agent, or Firm*—Thomas R. Lampe

(57) ABSTRACT

A paint can incorporates a rim having one or more drain holes formed therein to allow paint to drain into the interior of the can under the influence of gravity. The invention also encompasses a tool for forming the drain holes.

5 Claims, 2 Drawing Sheets

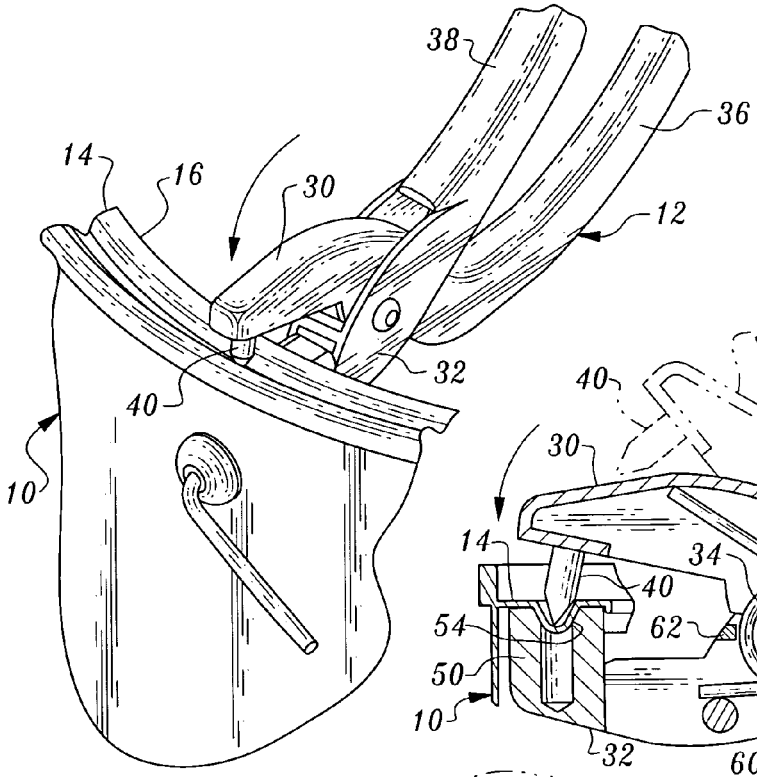
Fig. 2
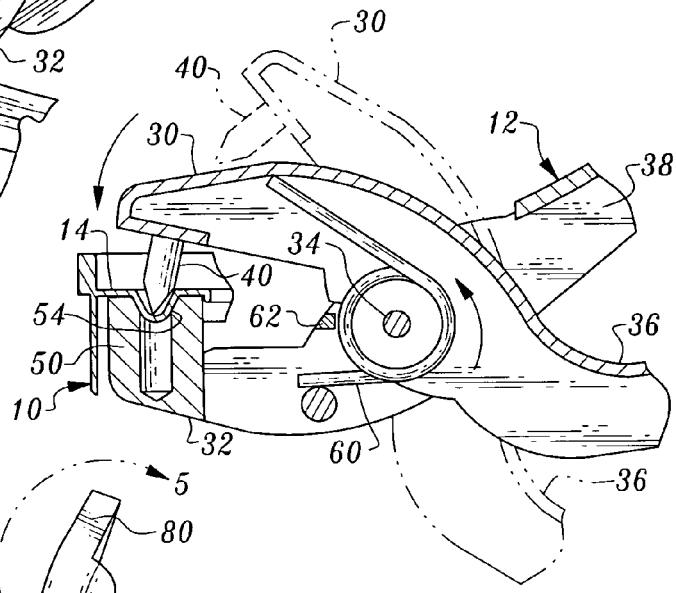
Fig. 3
Fig. 5
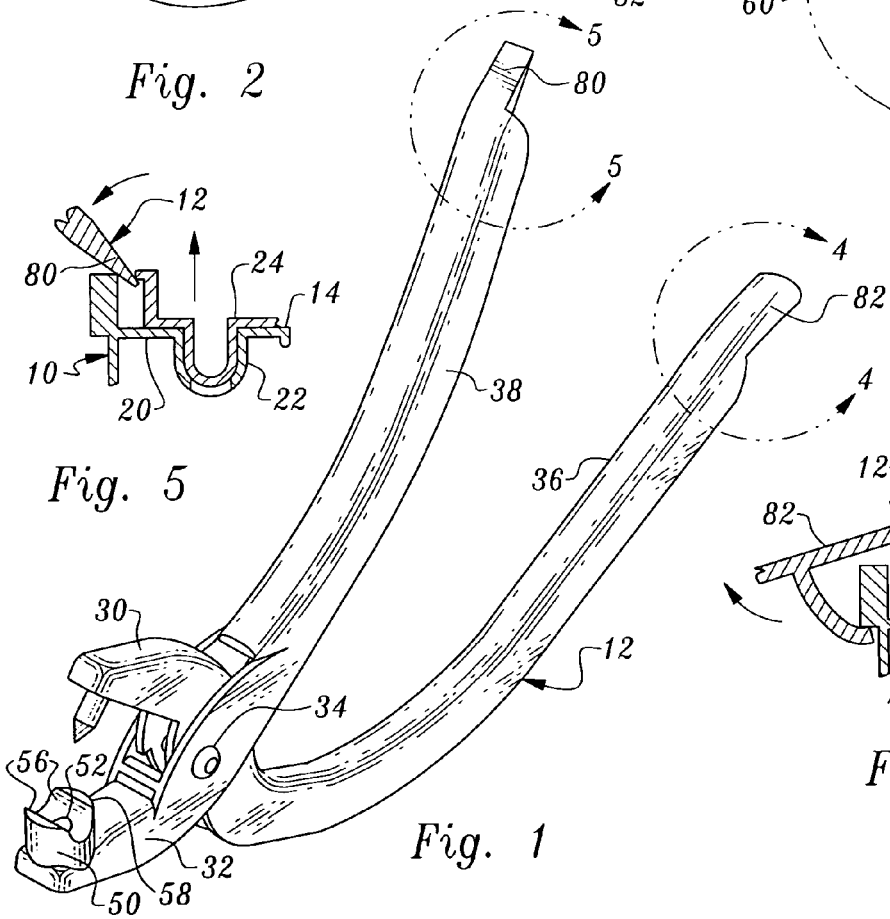
Fig. 1
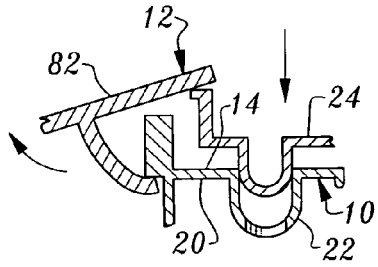
Fig. 4

PAINT CAN WITH DRAIN HOLES AND TOOL FOR FORMING THE HOLES

TECHNICAL FIELD

This invention relates to paint cans or other liquid receptacles having inwardly extending, annular rims for receiving a lid or closure. The invention encompasses a receptacle rim defining drain holes and a tool for forming the holes.

BACKGROUND OF THE INVENTION

Paint cans and similar receptacles typically employ inwardly extending, annular liquid receptacle rims defining an opening communicating with the interior of the receptacle. The rim bottom wall defines an open-topped, circular channel for releasably receiving a closure in the form of a lid.

One of the problems with such an arrangement is that paints or other liquids held by the receptacle often spill into the rim when the paint or other product in the can is being utilized. This can cause problems when the lid is re-applied. Spilled paint or other liquid in the rim can be displaced by the lid and spill over the sides of the receptacle, not only resulting in wasted paint or other liquid but also creating an unsightly mess both on the container, the surrounding area, and the person closing the container. Also, one may have problems removing the lid from the receptacle at a future date due to the fact that the paint or other spillage in the rim adhesively secures the lid in place. Furthermore, paint or other liquid in the rim can fall from the rim even when the container is open.

DISCLOSURE OF INVENTION

The present invention encompasses a paint can or other liquid receptacle having a rim which defines drain holes, allowing spillage to drain from the rim back into the interior of the receptacle body.

Also encompassed by the invention is a tool for use with a paint can or other liquid receptacle for forming one or more drain holes in the liquid receptacle rim providing liquid flow communication between an open-topped, circular channel formed in the rim and the interior of the receptacle to allow liquid in the open-topped circular channel to drain into the interior of the receptacle under the influence of gravity.

The tool includes a first rim engagement member for engaging the liquid receptacle rim bottom surface. A second rim engagement member is provided for engaging the liquid receptacle rim top surface.

The first rim engagement member and the second rim engagement member are selectively relatively movable toward or away from one another and cooperable to form a drain hole in the open-topped, circular channel of the rim when the first rim engagement member and the second rim engagement member relatively move toward one another.

Actuator structure is provided for selectively moving the first and second rim engagement members relatively toward or away from one another.

Other features, advantages and objects of the present invention will become apparent with reference to the following description and accompanying drawings.

BRIEF DESCRIPTION OF DRAWINGS

FIG. 1 is a perspective view of a tool constructed in accordance with the teachings of the present invention;

FIG. 2 is a perspective view showing portions of the tool and a paint can, the tool positioned prior to formation of a drain hole in the rim of the can by the tool;

FIG. 3 is an enlarged, cross-sectional view showing portions of the tool and paint can rim with the solid line depiction illustrating the tool in place just prior to formation of a hole in the rim and a phantom line depiction of the tool with one of the tool rim engagement members disengaged from the rim;

FIG. 4 is a greatly enlarged cross-sectional view of that portion of the tool delineated by double-headed arrow 4—4 in FIG. 1 being used to attach a lid to the paint can rim;

FIG. 5 is a greatly enlarged, cross-sectional view showing that portion of the tool delineated by double-headed arrow 5—5 in FIG. 1 utilized to pry the lid from the paint can rim to open the paint can;

MODES FOR CARRYING OUT THE INVENTION

Figure 6:
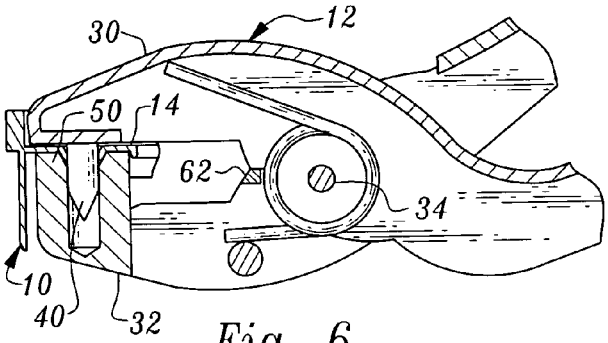
FIG. 6 is a view similar to FIG. 3, but illustrating the tool after formation of the drain hole.
Figure 7:
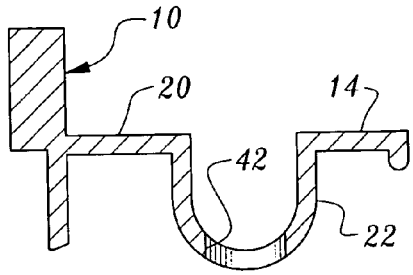
FIG. 7 is a greatly enlarged, cross-sectional view of a portion of the paint can rim showing a drain hole, as taken along line 7—7 in FIG. 8.

Referring now to FIGS. 1–8, a paint can is designated by reference numeral 10 and a tool for forming one or more drain holes in the rim of the paint can is designated by reference numeral 12.

The paint can 10 has an inwardly extending, annular liquid receptacle rim defining an opening 16 communicating with the interior of the paint can. As is conventional, the rim has a liquid receptacle rim top surface and a liquid receptacle rim bottom surface. The liquid receptacle rim includes a liquid receptacle rim bottom wall 18 defining an open-topped, circular channel 22. The paint can structure defined thus far is of conventional construction.

The channel 22 is for releasably receiving a closure in the form of a lid for the paint can. FIGS. 4 and 5 show a portion of the lid 24, the lid also being of a conventional nature.

Tool 12, as stated above, is for the purpose of forming one or more drain holes in the rim 14, in particular at the bottom of the channel 22 defined by rim bottom wall 20. The tool 12 includes two rim engagement members 30, 32 which are pivotally connected about a pivot 34. Manually engageable handles 36, 38 are respectively integral with the rim engagement members 30, 32, the handles comprising actuator structure for selectively moving the rim engagement members relatively toward or away from one another.

Rim engagement member 30 includes a pointed piercing element 40 for piercing the open-topped channel 22 of the rim when the tool is positioned relative to the rim as shown in FIGS. 2, 3 and 6. FIGS. 2 and 3 show the piercing element 40 prior to forming the drain hole and FIG. 6 illustrates the piercing element after the drain hole has been formed.

Figure 8:
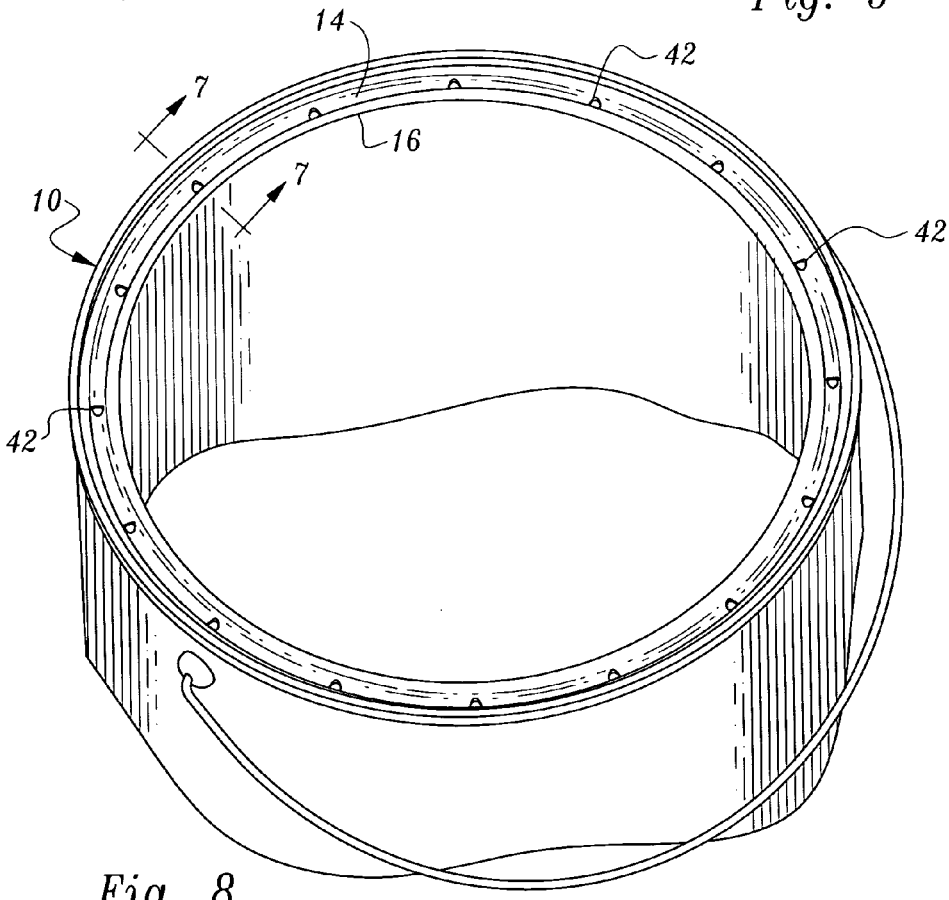
FIG. 8 is a top, perspective view of a paint can having a plurality of spaced drain holes formed in the rim thereof.

Preferably a plurality of drain holes 42 are formed in the rim as shown in FIG. 8 at spaced locations.

Rim engagement member 32 includes a socket element 50 which receives the piercing element 40 (as shown in FIG. 6) during piercing of the channel by the piercing element, the piercing element passing downwardly through a socket element opening 52. The socket element further defines a socket element concavity 54 leading to socket element opening 52 and receiving a portion of the open-topped, circular channel 22 to position the socket element at a selected location relative to the channel during piercing of the channel by the piercing element.

More particularly, the socket element has a distal end in the form of spaced distal end portions 56, 58 defining concavity 54. The distal end portions 56, 58 generally conform to the shape of the channel where the distal end portions engage the channel. The distal end portions are disposed on opposed sides of the channel during the piercing operation to provide stability between the tool and rim and ensure that the tool is properly placed relative to the channel.

A spring 60 may be employed to continually urge the rim engagement members away from one another. A stop in the form of a projection extending outwardly from rim engagement member 32 is engageable by rim engagement member 30 to limit movement of the rim engagement members toward one another. This is shown in FIG. 6. The stop prevents the rim engagement members from unduly distorting the shape of the rim during the piercing operation so that the lid may readily be reapplied if desired.

Figure 9:
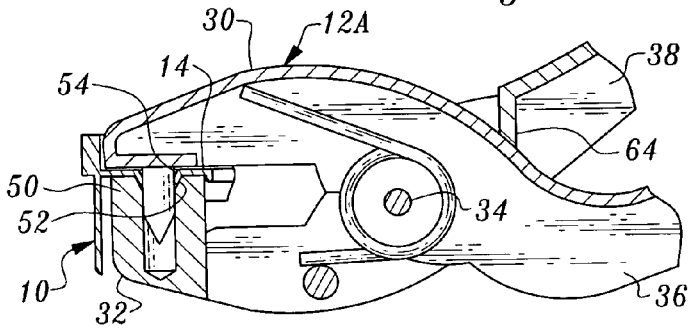
FIG. 9 is a view similar to FIG. 6, but illustrating an alternative embodiment of the invention.

FIG. 9 illustrates an alternative form of the tool wherein the stop is in the nature of a projection 64 extending downwardly from handle 38 and engageable with handle 36 to limit movement of the rim engagement members toward one another.

Figure 10:
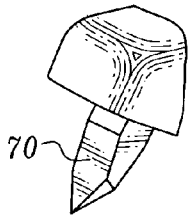
FIG. 10 is an enlarged, perspective view of an alternative form of piercing element which may be incorporated in the tool.

Piercing element 40 has a round cross-section and forms round drain holes 42. Other shapes of piercing elements may be employed. For example, FIG. 10 shows a piercing element 70 which is configured to form an elongated drain hole. Regardless of the shapes of the drain holes, it will be appreciated that the lid, once reapplied, will cover up the drain holes and prevent paint from leaking from the can interior into the channel.

A wedge-shaped prying element 80 is attached at the distal end of handle 38. As shown in FIG. 5, the prying element 80 is used for prying the closure or lid away from the can rim when one wishes to open the can, the prying element simultaneously engaging the lid and the can during the process.

A closure engagement element 82 is located at the distal end of handle 36. FIG. 4 shows the configuration of the closure engagement element and its cooperative engagement with the paint can and the lid 24 to exert downward pressure on the lid to reattach the lid to the paint can when the closure engagement element is manually pivoted.

It will be appreciated that drain holes, such as drain holes 42, can be formed in the rim of the paint can or other liquid receptacle during manufacture, rather than formed by a tool at a subsequent date. The present invention encompasses a liquid receptacle having drain holes, whether formed by a tool after purchase or incorporated in the liquid receptacle structure prior to use.

The invention claimed is:

1. A liquid receptacle piercing tool for use with a paint can or other liquid receptacle having an inwardly extending, annular liquid receptacle rim defining an opening communicating with the interior of the receptacle and having a liquid receptacle rim top surface and a liquid receptacle rim bottom surface, said liquid receptacle rim including a liquid receptacle rim bottom wall defining an open-topped, circular channel for releasably receiving a closure for said liquid receptacle, said tool for forming one or more drain holes in said liquid receptacle rim providing liquid flow communication between said open-topped, circular channel and the interior of said receptacle to allow liquid in said open-topped, circular channel to drain into the interior of said receptacle under the influence of gravity, said liquid receptacle piercing tool comprising, in combination:

a first rim engagement member for engaging said liquid receptacle rim bottom surface;

a second rim engagement member for engaging said liquid receptacle rim top surface, said first rim engagement member and said second rim engagement member being selectively relatively movable toward or away from one another and cooperable to form a drain hole in said open-topped, circular channel when said first rim engagement member and said second rim engagement member relatively move toward one another; and actuator structure for selectively moving said first and second rim engagement members relatively toward or away from one another, said second rim engagement member including a downwardly extending piercing element for entering the open-topped, circular channel and piercing said open-topped circular channel when said first and second rim engagement members relatively move toward one another, and said first rim engagement member including a socket element receiving said piercing element during piercing of said open-topped, circular channel by said piercing element, said socket element defining a socket element opening for receiving said piercing element and through which said piercing element moves downwardly during piercing of said open-topped, circular channel and further defining a socket element concavity above said socket element opening and in communication therewith for receiving a downwardly extending portion of said open-topped, circular channel with the first rim engagement member engageable with the open-topped circular channel at opposed sides thereof to position said socket element at a selected location relative to said open-topped, circular channel and the socket element opening below said open-topped, circular channel substantially aligned with said piercing element during piercing of said open-topped, circular channel by said piercing element, said socket element further including a socket element distal end having spaced distal end portions disposed upward from said socket element opening and defining said socket element concavity, said distal end portions engageable with said open-topped, circular channel and with spaced segments of said annular liquid receptacle rim disposed on opposed sides of said open-topped, circular channel.

2. The liquid receptacle piercing tool according to claim 1 wherein said distal end portions generally conform to the shape of said open-topped, circular channel where said distal end portions engage said open-topped circular channel.

3. The liquid receptacle piercing tool according to claim 1 additionally comprising a stop for limiting movement of said first and second rim engagement members toward one another.

4. The liquid receptacle piercing tool according to claim 1 additionally comprising a prying element for simultaneously engaging the closure and the liquid receptacle for prying the closure away from the liquid receptacle rim.

5. The liquid receptacle piercing tool according to claim 1 additionally comprising a closure engagement element for simultaneously engaging the closure and the liquid receptacle for exerting downward pressure on the closure to secure the closure to the receptacle.

* * * * *